United States Patent [19]

Noding

[11] Patent Number: 4,464,236

[45] Date of Patent: Aug. 7, 1984

[54] SELECTIVE ELECTROCHEMICAL OXIDATION OF ORGANIC COMPOUNDS

[75] Inventor: Stephen A. Noding, Brusly, La.

[73] Assignee: The Dow Chemical Company, Midland, Mich.

[21] Appl. No.: 493,878

[22] Filed: May 12, 1983

Related U.S. Application Data

[63] Continuation-in-part of Ser. No. 376,805, May 10, 1982, abandoned.

[51] Int. Cl.[3] ..... B01K 1/00; C07C 49/62; C07B 29/06

[52] U.S. Cl. ..... 204/78; 204/252

[58] Field of Search ..... 204/283, 78, 98, 295, 204/252, 257, 229

[56] References Cited

U.S. PATENT DOCUMENTS

| | | | |
|---|---|---|---|
| 1,322,580 | 11/1919 | Kitchen . | |
| 2,130,151 | 9/1938 | Palfreeman et al. | 204/9 |
| 2,285,858 | 6/1942 | Horrobin et al. | 204/78 |
| 3,509,031 | 4/1970 | Covitz | 204/78 |
| 3,592,748 | 7/1971 | Wehrli | 204/78 |
| 3,721,615 | 3/1973 | Fremery et al. | 204/73 |
| 3,758,391 | 9/1973 | Anderson et al. | 204/78 |
| 3,758,392 | 9/1973 | Anderson et al. | 204/78 |
| 3,776,824 | 12/1973 | Bernstein et al. | 204/78 |
| 3,836,441 | 9/1974 | Millington | 204/78 |
| 3,884,776 | 5/1975 | Keidel | 204/73 |
| 3,897,319 | 7/1975 | Anderson et al. | 204/78 |
| 3,909,376 | 9/1975 | Degner | 204/73 |
| 4,032,427 | 6/1977 | Kadija | 204/283 |
| 4,071,429 | 1/1978 | Wagenknecht et al. | 204/231 |
| 4,124,477 | 11/1978 | Tokawa et al. | 204/252 |
| 4,133,726 | 1/1979 | Wagenknecht et al. | 204/59 |
| 4,209,368 | 6/1980 | Cooker et al. | 204/98 |
| 4,224,129 | 9/1980 | McIntyre et al. | 204/263 |
| 4,297,194 | 10/1981 | Dotson et al. | 204/257 |
| 4,312,720 | 1/1982 | Lefevre | 204/78 |
| 4,332,662 | 6/1982 | Pouli et al. | 204/265 |

*Primary Examiner*—T. Tung
*Assistant Examiner*—Nathan Thane
*Attorney, Agent, or Firm*—A. J. Young

[57] ABSTRACT

The present invention relates to a method and electrochemical cell useful for the selective electrochemical oxidation of aryl-compounds including aromatic and polynuclear aromatic hydrocarbons such as benzene, naphthalene and anthracene or their derivatives such as phenols and naphthols. The anodic electrode of the cell includes a first foraminous or porous layer of a hydrophobic material; a second foraminous or porous layer which includes an oxidation catalyst; and an electrical current collector in contact with the second layer. As a result of the special chemical properties and porosity of the first and second layers of the anode, and because of careful control of the pressure differential between the electrolyte solution and the aryl-compound, an active interface is formed by the electrolyte solution and aryl-compound between the first and second layers or in the second layer of the anode thereby providing for very selective controlled oxidation of the aryl-compound with excellent current efficiencies.

7 Claims, 1 Drawing Figure

SELECTIVE ELECTROCHEMICAL OXIDATION OF ORGANIC COMPOUNDS

CROSS REFERENCE TO RELATED APPLICATION

This application is a continuation-in-part of an original application, Ser. No. 376,805, filed May 10, 1982, now abandoned.

BACKGROUND OF THE INVENTION

This invention relates to electrochemical oxidation. More particularly, this invention relates to the selective electrochemical oxidation of aryl-compounds and their derivatives to quinoid compounds.

Known methods for the electrochemical oxidation of organic compounds include dissolving or suspending the organic compounds to be oxidized in an aqueous electrolyte solution and passing this mixture through an electrochemical cell. Such methods have the inherent disadvantage that the organic compounds may be at least partially oxidized to an oxidation level beyond that of the desired product due primarily to the cell design. The product selectivity and current efficiency of such electrochemical methods may be lowered and undesired byproducts can be formed.

SUMMARY

In general, the present invention provides an electrochemical cell and a method for the selective electrochemical oxidation of aryl-compounds and their derivatives to quinoid compounds.

The electrochemical cell for oxidizing an aryl-compound includes a cell body forming a compartment to hold an aqueous electrolyte solution; an anodic electrode including a first foraminous or porous layer of a hydrophobic material, a second foraminous or porous layer with an oxidation catalyst dispersed therein, and a current collector in electrical contact with the second layer, the second layer positioned to provide contact with the aqueous electrolyte solution; a cathodic electrode positioned to provide contact with the aqueous electrolyte; means for transporting the aryl-compound through the first layer to the second layer of the anodic electrode; means for maintaining a pressure differential between the aqueous electrolyte solution and the aryl-compound sufficiently low to prevent substantial bulk intermixing of the aryl-compound and aqueous electrolyte solution or flow of either the electrolyte solution or the aryl-compound through the anodic electrode whereby a substantially uniform interface of the aryl-compound and the aqueous electrolyte solution is formed at the boundary between the first and second layers or in the second layer of the anodic electrode; means for removing the quinoid oxidation product from the cell; and means for supplying an electrical current between the cathodic and anodic electrodes.

The method for the selective electrolytic oxidation of an aryl-compound to a quinoid compound includes the steps of disposing an aqueous electrolyte solution in a compartment of an electrochemical cell with the electrolyte solution contacting a cathodic and an anodic electrode, the anodic electrode including a first foraminous or porous layer of hydrophobic material, a second foraminous or porous layer with an oxidation catalyst dispersed therein, and a current collector in electrical contact with the second layer, the first layer positioned to contact the aryl-compound and the second layer positioned tocontact the aqueous electrolyte solution; transporting the aryl-compound through the first hydrophobic layer to the second layer of the anodic electrode; maintaining a pressure differential between the aqueous electrolyte solution and the aryl-compound sufficiently low to prevent substantial bulk intermixing of the aryl-compound and aqueous electrolyte solution or flow of either the electrolyte solution or the aryl-compound through the anodic electrode whereby a substantially uniform interface between the aryl-compound and the aqueous electrolyte solution is formed at the boundary between the first and second layers or in the second layer of the anodic electrode; supplying an electrical current between the cathodic and anodic electrodes; and removing the quinoid oxidation product from the cell.

As defined herein aryl-compounds and their derivatives include, but are not limited to, aromatic compounds, polynuclear aromatic compounds, substituted aromatic and polynuclear aromatic compounds, and the like. In addition, depending on the operation of the cell, the design of the anodic electrode such as the porosity of first and second layers, and the preferential solubility of the quinoid oxidation product, it is possible to remove the oxidation product on either the organic or the aqueous electrolyte side of the cell.

It is an object of this invention to provide a method and an electrochemical cell for the selective oxidation of aryl-compounds. It is a further object of this invention to provide means whereby a desired oxidation product is protected from further oxidation prior to recovery. It is a further object of this invention to provide an electrochemical apparatus characterized by high selectivity and current efficiencies. It is a further object of this invention to provide a method and an electrochemical cell for the selective oxidation of benzene or phenol to para-benzoquinone, naphthalene or naphthol, to 1,4-naphthoquinone, and anthracene to 9,10-anthroquinone. Other objects of the invention will be apparent to those skilled in the art from the more detailed description which follows.

DESCRIPTION OF THE PREFERRED EMBODIMENTS

Figure 1:
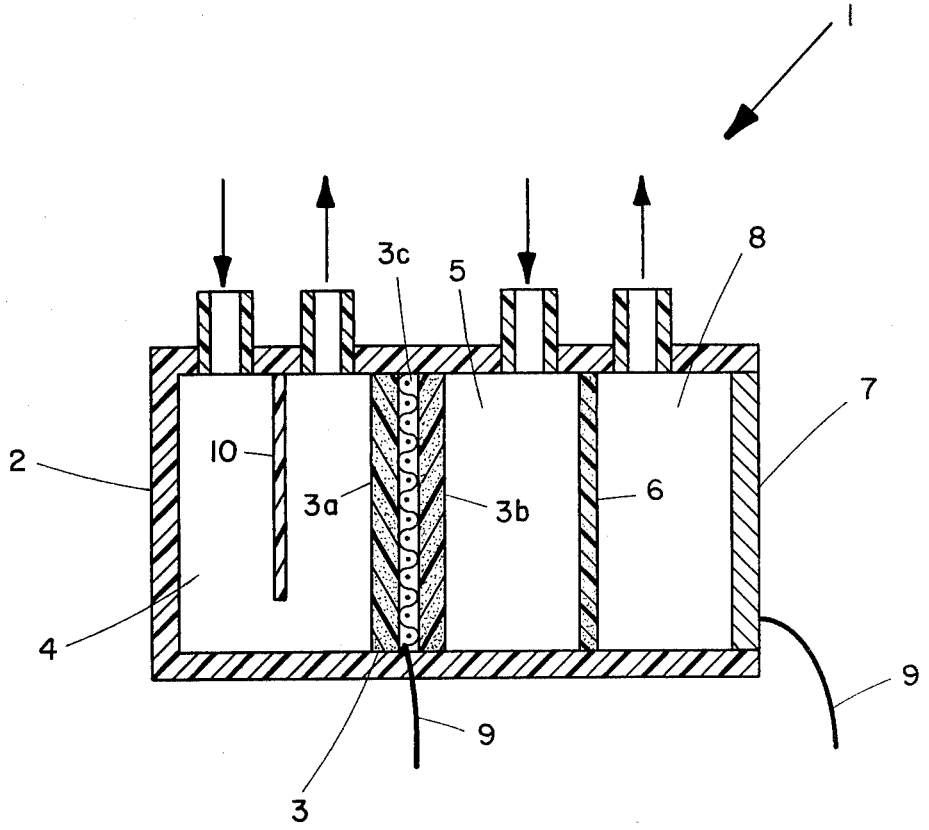
FIG. 1 is a schematic illustration of an electrochemical cell made according to the present invention.

The following description illustrates the manner in which the principles of the present invention are applied, but is not to be construed as in any sense limiting the scope of the invention.

More specifically, FIG. 1 illustrates a schematic representation of an electrochemical cell 1 made according to present invention.

The electrochemical cell 1 comprises cell walls 2; an anodic electrode 3; a cathodic electrode 7; a compartment 4, including a baffle or separator 10, for holding an aryl-compound; electrolyte solution compartments 5 and 8 separated by a porous membrane or layer 6; and electrical leads 9 attached to the anodic electrode 3 and cathodic electrode 7.

The anodic electrode 3 is formed of a first foraminous or porous layer 3*a* of a hydrophobic material, a second foraminous or porous layer 3*b* which includes an oxidation catalyst, and a current collector 3*c* separating the first layer 3*a* from and in electrical contact with the second layer 3*b*. The hydrophobic material forming the first layer 3*a* is preferably porous polytetrafluoroethylene. The second layer 3*b* may be formed from a composition of hydrophobic material and any well known oxidation catalyst, but is preferably formed from a composition of polytetrafluoroethylene and lead dioxide. The current collector 3*c* is preferably a conductive metal screen which is, most preferably, made of lead.

The second layer 3*b* of the anodic electrode 3 is further characterized as having a high degree of porosity and large specific-surface area. The specific-surface area is preferably between about twenty and about thirty square meters per gram. Also, the composition of the second layer 3*b* is preferably between about eighty and about ninety percent lead dioxide, and between about ten and about twenty percent polytetrafluoroethylene by weight. Layer 3*b* is preferably fabricated by forming a mixture of about eighty percent lead dioxide, about ten percent polytetrafluoroethylene, and about ten percent granular sodium by weight and then calendering, sintering, water-leaching, and drying the layer using techniques which are well known for producing a porous teflon sheet. The composition of the dried layer 3*b* produced in this manner would be about eighty-nine percent lead dioxide and about eleven percent polytetrafluoroethylene by weight. The lead dioxide used in the composition of layer 3*b* may be freshly prepared using the procedure described by L. C. Newell and R. D. Maxson, *Inorganic Synthesis,* Volume 1, p. 45, which is incorporated by reference. Lead dioxide prepared in this manner is characterized as spongy and porous, with a specific surface area of between about twenty and about forty square meters per gram.

The cathodic electrode 7 of cell 1 may be characterized as chemically inert to the aqueous electrolyte solution in compartments 5 and 8 when an electrical current is passed between the electrodes 3 and 7. The electrode 7 is preferably made from platinum or lead, and most preferably, is made from lead. In addition, the cell 1 may include a porous layer 6 and a separator 10. Layer 6 may be formed from any inert porous material such as porous Teflon or a glass frit, and is utilized to help minimize the threat of an explosive mixture of hydrogen and oxygen forming in case of an uncontrolled cell voltage upset. Separator 10 may be formed of any material that is chemically inert to the aryl-compound being oxidized, the solvent used to transport to aryl-compound, or the oxidation products, and will provide for more efficient separation and recovery of the oxidation products. The cell walls 2 may also be characterized as chemically inert or resistant to the aryl-compound, solvent, or electrolytic solution which they contact. For example, the separator 10 and cell walls 2 around compartment 4 may be formed from heavy metals or polyvinylester resins, and the cell walls 2 around compartments 5 and 8 may be formed from polytetrafluoroethylene resins, polyvinylidene fluoride resins or titanium metal.

The supporting aqueous electrolyte solution disposed in compartments 5 and 8 may include an acid, salt, or a mixture of both. Preferably, the electrolyte solution is formed from an acid, and more preferably, the acid is an inorganic acid such as sulfuric acid. The most suitable concentration of the sulfuric acid electrolyte solution is between about three and about seven percent by weight, and the acid solution may be further saturated with lead sulfate to minimize the loss of lead dioxide from layer 3*b* of the anode electrode 3.

The aryl-compounds disposed in compartment 4 which may be selectively oxidized according to the present invention include aromatic and polynuclear aromatic hydrocarbons such as benzene, naphthalene and anthracene, and their derivatives such as phenols and naphthols. Preferably, the aryl-compounds to be oxidized are benzene, naphthalene, anthracene, and phenol; and the quinoid compounds produced are parabenzoquinone, 1,4-naphthoquinone, and 9,10-anthroquinone. In carrying out the oxidation process in the cell 1, the difference in electrical potential across the cell electrodes 3 and 7 is controlled to provide oxygen from electrolytically decomposed water at a rate sufficient to selectively produce the desired oxidation products. If the potential is too low, conversion and current efficiencies may be poor, and if the potential is too high, undesirable oxidation byproducts may be formed. If necessary or desirable, an inert solvent may be used to form a solution with the aryl-compound to be oxidized. The solvents selected should be chemically inert under the reaction condition of cell 1, and for example, may include methylene chloride, hexane, diethyl ether, and mixtures of these or other similar solvents.

Cell 1 is used to produce selective oxidation products by first placing the desired organic compound in compartment 4 and the supporting aqueous electrolyte in compartments 5 and 8. An electrical current is then passed through cell 1 by connecting electrodes 3 and 7, through electrical leads 9, to the positive and negative terminals, respectively, of a suitable battery or other power source, not shown. As electrolysis proceeds, the organic compound or solution thereof diffuses through the layer 3*a* and screen 3*c* into layer 3*b* of the anodic electrode 3. At the same time, the electrolyte solution diffuses through the layer 3*b* and contacts the organic compound to form an interface within the porous layer 3*b*. Selective electrochemical oxidation of the organic compound takes place at this interface. This interface is first formed as a result of the special chemical properties of layers 3*a* and 3*b* and is carefully maintained by controlling the pressures of the aqueous electrolyte solution and aryl-compound in compartments 4 and 5 such that there is no substantial pressure differential between the two compartments. There are many well known methods of measuring and controlling liquid pressures, such as pump and valve systems, that can be used with cell 1, with the final selection dependent on the specific needs of the user's application.

The oxidation product formed in cell 1 then diffuses back into compartment 4 and is removed from the cell 1 as shown in FIG. 1. The oxidation product may then be separated from any inert solvent or residual aryl-compound by conventional known techniques such as fractional distillation or fractional crystallization, and the remaining solvent and aryl-compound, along with fresh aryl-compound, may be recycled back to compartment 4 in cell 1 as shown in FIG. 1. In like manner, the electrolyte solution may be removed from and returned to compartments 5 and 8, respectively, as shown in FIG. 1, thereby providing for control of the electrolyte solution concentration and removal of any impurities. Also, depending on the operating conditions of cell 1, the design features of the layers 3*a* and 3*b* such as porosity, and the chemical properties of the oxidation product, it is possible, although not preferred, to remove the product with the electrolyte solution.

The prevention of bulk mixing of the aryl-compound or solution thereof and the electrolyte solution by control of pressure in cell 1 and design of layers 3*a* and 3*b* is an important feature of the present invention. As previously noted, the known technology utilizes a solution or a suspension of an organic compound in the supporting electrolyte solution which is transported through an electrochemical cell to electrolytically oxidize the compound. In the present cell, bulk contact between the aryl-compound or solution thereof and the electrolyte solution is restricted to the interface within the anodic electrode 3, thereby preventing intermixing and further over-oxidation of the desired product to an undesirable higher oxidation state. This result is made possible by control of pressures in cell 1 and by the construction of the anodic electrode 3, whereby the electrical current transmitted to layer 3*b* of the electrode 3 is uniformly distributed from layer 3*c* through the pores of the layer 3*b* to the aryl-compound or solution thereof and the electrolyte solution at the liquid-liquid interface. A second important feature of the anodic electrode 3 is that, by virtue of its structure, the aryl-compound, or solution of the aryl-compound is restricted from diffusing through the layer 3*b* into the electrolyte solution. These unique structural features of the anodic electrode 3 and the cell 1 beneficially permit the use of high current densities which result in high current efficiencies, as well as provide the basis for highly selective oxidation of the aryl-compounds by electrolysis.

In one of the preferred modes of operating the cell 1, the anodic and cathodic potentials may be controlled individually and separately by using known anodic and cathodic probes to measure the anode and cathode electrode potentials relative to a standard reference electrode, not shown in FIG. 1. For example, in a process for oxidizing benzene to para-benzoquinone and naphthalene to 1,4-naphthoquinone, the potential difference across the cell 1 may be between about two and about four volts, and preferably, between about two-and-one-half volts and about three-and-one-half volts. However, the anodic potential of the anodic electrode 3 may be controlled between about 1.5 and about 1.7 volts with an anodic probe relative to a saturated calomel electrode, thereby providing a more sensitive control of the rate of oxygen formation and subsequent oxidation product selectivity at the interface of the aryl-compound and electrolyte solution.

The present invention is further illustrated by means of the following examples:

EXAMPLE 1

Using an electrode and cell made according to the present invention and five percent by weight aqueous sulfuric acid solution as a supporting electrolyte, benzene was oxidized to para-benzoquinone. The cell temperature was ambient, the anodic potential was +1.5 volts relative to a saturated calomel electrode, and the anodic current density varied between fifteen and twenty-five milliamperes per square centimeter. Para-benzoquinone was produced with a ninety-five percent selectivity and a ninety percent current efficiency.

EXAMPLE 2

Using an electrode and cell similar to Example 1 and five percent by weight aqueous sulfuric acid solution saturated with lead sulfate as a supporting electrolyte, naphthalene was oxidized to 1,4-naphthoquinone. The cell temperature was ambient, the naphthalene was dissolved in hexane to provide a solution containing fifteen percent naphthalene by weight, the anodic potential was about +1.5 volts relative to a saturated calomel electrode, and the anodic current density varied between fifteen and twenty-five milliamperes per square centimeter. 1,4-Naphthoquinone was produced with about ninety-five percent selectivity and seventy percent current efficiency.

EXAMPLE 3

Using an electrode and cell similar to Example 1 and five percent by weight aqueous sulfuric acid solution saturated with lead sulfate as a supporting electrolyte, phenol was oxidized to para-benzoquinone. The cell temperature was ambient, the phenol was dissolved in benzene at a concentration of three-and-one-half weight percent, the anodic potential was +1.5 volts relative to a saturated calomel electrode, and the anodic current density varied between fifteen and twenty-five milliamperes per square centimeter. Para-benzoquinone was produced with a ninety-percent selectivity and an eighty-percent current efficiency. In general, the anode potential for this reaction was approximately fifty millivolts lower at the same current density compared to the reaction of benzene alone in Example 1.

EXAMPLE 4

Using an electrode and cell similar to Example 1, and five percent by weight aqueous sulfuric acid solution saturated with lead sulfate as a supporting electrolyte, phenol was oxidized to para-benzoquinone. The cell temperature was ambient. The phenol was dissolved in n-hexane in one run and in methylene chloride in a second run, at a concentration of three weight percent. The anodic potential was +1.58 volts relative to the saturated calomel electrode, and the anodic current density varied between fifteen and twenty-five milliamperes per square centimeter. Para-benzoquinone was produced in both runs with a one-hundred percent selectivity, and an eighty-five percent current efficiency for the n-hexane run and an eighty-two percent current efficiency for the methylene-chloride run.

EXAMPLE 5

Using an electrode and cell similar to Example 1, and five percent by weight aqueous sulfuric acid solution saturated with lead sulfate as a supporting electrolyte, anthracene was oxidized to 9,10-anthroquinone. The cell temperature was ambient. The anthracene was dissolved in hexane to a concentration of one percent by weight. The anodic potential was between +1.8 and +2.0 volts relative to the saturated calomel electrode. The cathodic potential was −1.2 volts relative to the saturated calomel electrode. The anodic current density was seven milliamperes per square centimeter. The 9,10-anthroquinone was produced at a current efficiency of about fifty percent and a selectivity of about ninety percent.

While certain representative embodiments and details have been shown for the purpose of illustrating the present invention, it will be apparent to those skilled in the art that various changes and modifications can be made therein without departing from the spirit and scope of the invention.

What is claimed is:

1. A method for the selective electrolytic oxidation of an aryl-compound to a quinoid compound which comprises the steps of: (a) disposing an aqueous electrolyte solution in a compartment of an electrochemical cell with the electrolyte solution contacting a cathodic and an anodic electrode; the anodic electrode including a first foraminous or porous layer of hydrophobic material, a second foraminous or porous layer with an oxidation catalyst dispersed therein, and a current collector in electrical contact with the second layer, the first layer positioned to contact the aryl-compound and the second layer positioned to contact the aqueous electrolyte solution; (b) transporting the aryl-compound through the first hydrophobic layer to the second layer of the anodic electrode; (c) maintaining a pressure differential between the aqueous electrolyte solution and the aryl-compound sufficiently low to prevent substantial bulk intermixing of the aryl-compound and aqueous electrolyte solution or flow of either the electrolyte solution or the aryl-compound through the anodic electrode whereby a substantially uniform interface between the aryl-compound and the aqueous electrolyte solution is formed at the boundary between the first and second layers or in the second layer of the anodic electrode; (d) supplying an electrical current between the cathodic and anodic electrodes; and (e) removing the quinoid oxidation product from the cell.

2. The method of claim 1 wherein the aryl-compound is an aromatic compound, polynuclear aromatic compound, a substituted aromatic compound, a substituted polynuclear aromatic compound or a mixture thereof.

3. The method of claim 1 wherein the oxidation catalyst in the second layer of the anodic electrode is finely divided lead dioxide.

4. The method of claim 2 wherein the aromatic compound is benzene and the quinoid compond is para-benzoquinone.

5. The method of claim 2 wherein the polynuclear aromatic compound is naphthalene or anthracene and the quinoid compound is 1,4-naphthoquinone or 9,10-anthroquinone, respectively.

6. The method of claim 2 wherein the substituted aromatic compound is phenol and the quinoid compound is para-benzoquinone.

7. The method of claim 2 wherein the substituted polynuclear aromatic compound is a naphthol and the quinoid compound is 1,4-naphthoquinone.

* * * * *